United States Patent [19]

Reineman et al.

[11] Patent Number: 4,854,641

[45] Date of Patent: Aug. 8, 1989

[54] ADJUSTABLE CHAIR

[76] Inventors: Richard G. Reineman, 3698 Zola St., San Diego, Calif. 92106; George P. Carver, 26 Linda Isle, Newport Beach, Calif. 92660

[21] Appl. No.: 300,398

[22] Filed: Jan. 23, 1989

[51] Int. Cl.[4] ..... A47C 3/20

[52] U.S. Cl. ..... 297/345; 297/340; 297/353

[58] Field of Search ..... 297/316, 338, 340, 345

[56] References Cited

U.S. PATENT DOCUMENTS

| | | | |
|---|---|---|---|
| 2,365,200 | 12/1944 | Lorenz | 297/301 |
| 2,615,496 | 10/1952 | Lorenz et al. | 297/300 |
| 2,859,799 | 11/1958 | Moore | 297/301 |
| 3,902,755 | 9/1975 | Sirot | 297/339 |
| 3,913,975 | 10/1975 | Carter | 297/307 |
| 4,173,372 | 11/1979 | Norris | 297/345 |
| 4,387,876 | 6/1983 | Nathan | 297/345 |
| 4,763,950 | 8/1988 | Tobler | 297/301 |

FOREIGN PATENT DOCUMENTS

| | | | |
|---|---|---|---|
| 39393 | 6/1887 | Fed. Rep. of Germany | 297/340 |

*Primary Examiner*—Peter R. Brown

*Attorney, Agent, or Firm*—Frank C. Price

[57] ABSTRACT

A chair with adjustable seat height in which the height change, made to suit the size of a given occupant, will at the same time change the height of the back rest above the seat. The amount of rise of the back rest is arranged to be in accordance with the proportions of average people. There is a pivoting, four-bar parallelgram-type linkage which raises the back support relative to the seat as the seat is raised. The front part of the linkage is fixed in height while the rear part raises and lowers the seat back. The linkage is rotated upward at the rear of the chair by one pin in the middle of the linkage which rises with the seat. An additional movement is developed in the linkage by having it bent downward toward the rear of the chair. The movement developed is a shifting of the seat back rearward of the seat as the seat rises.

2 Claims, 3 Drawing Sheets

8
6
37
2
1
18
33
35
24
20
11
10
19
7
9
34
12
30
13
3
31
21
4
5

ADJUSTABLE CHAIR

BACKGROUND

1. Technical Field

The present invention relates to the apparatus of a chair which allows the chair's height and other dimensions to be modified readily for comfort by any person of a particular size about to use the chair.

This invention is in the field of office furniture, although it is particularly applicable to chairs used at stations of control of operations. The operators in such cases need excellent seating comfort as they sit for long periods concentrating on the operation which they survey or control. Finally, the invention is especially applicable when such operations are around the clock with changes of operators, each needing his own comfortable chair configuration.

While there may be many ways to create coordinated adjustments between the back and the seat of a chair, the field of this invention is limited to those which include adjustments by hinging or by rotation of connecting links between the seat, the back and the stationary base of the chair as a consequence of the chair height itself being raised or lowered by any of several means to fit the occupant.

2. Description of the Related Art

The chair designs which most nearly approach the concept of this invention are configured and operate as follows:

(1) A multipoint linkage between the seat and the back operates to pivot the seat of an off-road vehicle up and down about the front, lower edge of the seat cushion while at the same time the back cushion moves in the same direction in such a way as to optimize comfort as the progress of the vehicle over rough terrain causes bouncing and pitching. The type of linkage is novel in its own right.

(2) A very common design involves tilting of the seat with a concommitant relative hinging movement of the seat back. A plurality of moveable linkages is used to change the position of the back relative to the seat as the seat and the back are both tipped backward.

SUMMARY

The object of the present invention is to provide a chair with adjustable seat height which also has a coordinated change in the height of the back support above the seat. That change corresponds to the typical changes in the height of various persons' lumbar regions above their buttocks in relation to their corresponding heights of thighs (seated) above the floor. The ratio of the height of the chair seat to the height of the chair back above the seat is therefore derived from the data of studies of these proportions in humans.

The change of the height of the back above the seat, as the seat height is changed, is effected by a system of linkages. The front, upper and lower corners of the linkages are fixed relative to the base of the chair. The two rear hinge points of the linkages are attached to the back support. They rise upward as the seat rises. They do this by the upward throw of the rear linkages which is excecuted by rotation of the lower linkage bar about a pin through it which is attached to or connected to the moveable seat support column. The degree of throw created via that pin by seat height change is determined by the ratio of two distances, the distances along the lower linkage bar on either side of the pin connected to the seat support column. In the preferred embodiment the two more-or-less horizontal linkage bars are bent downward as they extend rearward from their central region. This causes a rearward movement of the seat back as it moves upward. Thus, not only are the seated-thigh-to-foot lengths and the buttocks-to-lumbar region lengths accomodated by the mechanism, the length of the horizontal part of the body resting on the seat is also accomodated.

A second object of the invention is to carry out the changes in the chair proportions with a mechanism that is compact, strong and simple in operation. The linkage system of this invention is concealed beneath the chair seat support.

While the basic invention accomodates the chair to various sizes of people, there are some people of unusual proportions. Some people of Asian extraction are especially long-wasted and some of African extraction are especially short wasted. These people require more or less adjustment than the basic mechanism will provide since its design stems from the proportions of most of the population, not all of it. To compensate for this the chair includes a separate, additional adjustment mechanism on the chair back support. The person using the chair, if the automatic adjustment does not suit him, can make an additional adjustment either to add to the back height or reduce it over and above what the automatic mechanism provides. Thus, in a minority of cases of people to be seated, the basic adjustment of this invention needs additional adjustment. That additional adjustment is minimized by the basic adjustment.

DESCRIPTION OF THE PREFERRED EMBODIMENT

Figure 1:
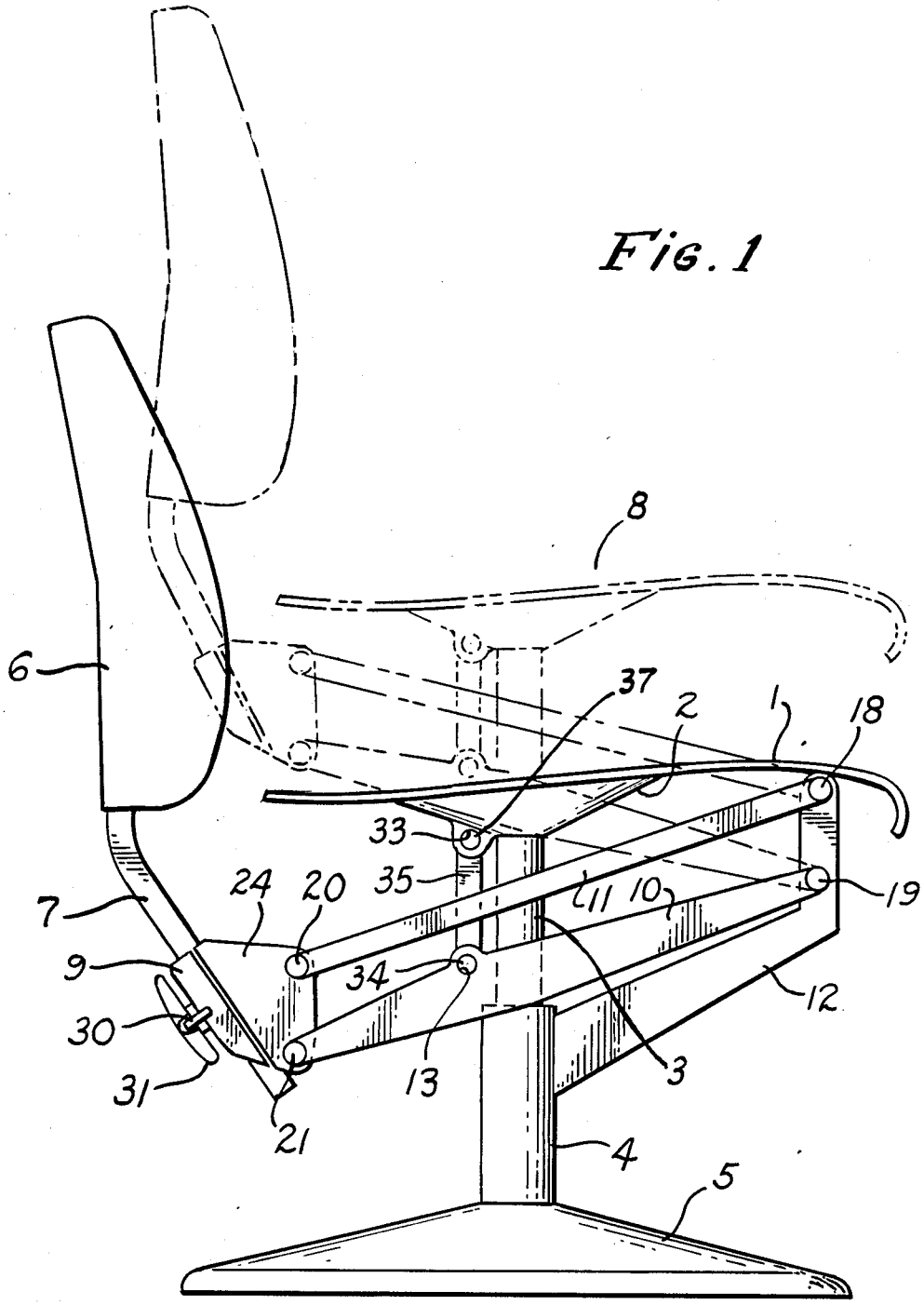
FIG. 1. is a side view in diagrammatic form illustrating the key moving parts and structure of the chair. Phantom lines indicate the chair seat raised.

In FIG. 1. the chair 8 has a seat surface 1 supported by a seat base 2 connected to a column 3 which moves vertically in the tube 4 which is attached to the floor base 5. There is a fixed extension 12 from the tube 4. Pins 18 and 19 in member 12 form two fixed pivot points for the linkages connecting pins 21-34-19-18-20. The adjusting linkages 10 and 11 connect to the back support 7 on flange 24 by pins 20 and 21. Linkage 10 forms an acceptance 13 for pin 34 which is a rising and falling pivot point of the linkage which moves with the seat support via the connecting link 35.

The moving parts within the mechanism can be seen primarily to be the moving linkage connections 20, 21 and 34 which rotate forward in the chair 8 as the tube 3 rises, the rotation being activated by linkage 10 which is constrained at pins 18 and 19 as pin 34 rises with support 2 to which it is attached. Thus, the seat back 6 will rise relative to the seat 1 as the linkage rotates forward or clockwise in the Figure. The ratio of the distance between pin 21 and pin 34 and the distance between pin 34 and pin 19 determines the proportionate rise in the seat back 6 above seat 1 as the seat support 2 rises with column 3. The ratio of those two distances is designed to make the rises of the seat back normal for the increases in distance, buttocks-to-lumbar region, for different persons as their bodily distance, feet-to-knees, increases. The rise of the seat can be accomplished by any of a number of means such as manually lifting or manually operating a screw mechanism, or by gas spring, electric motor and gears. Hydraulic pumping is possible.

Figure 2:
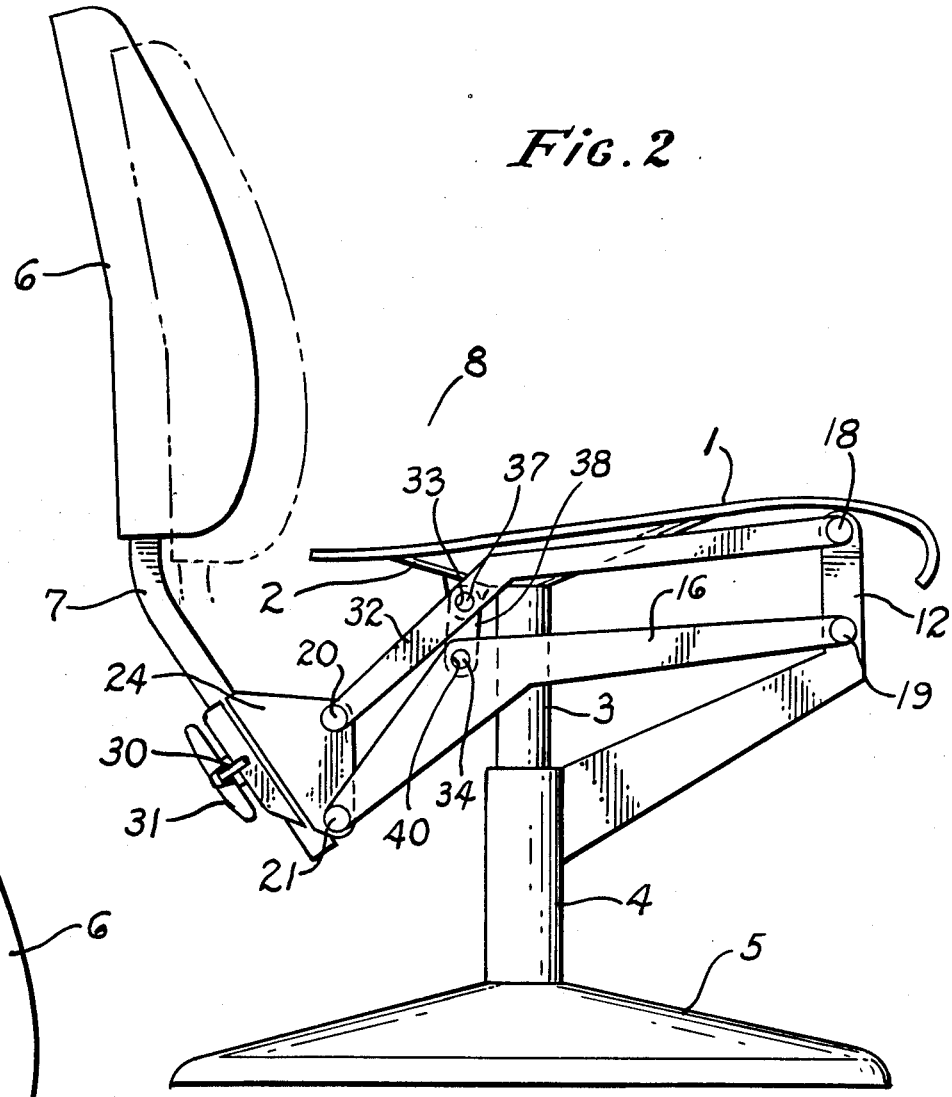
FIG. 2. is similar to FIG. 1 except the front-to-back linkages are bent downward toward the rear of the chair. Phantom lines indicate how the chair back moves forward for a lower seat height.

In FIG. 2. a form of linkage is shown incorporated to allow, also, a movement of the seat back rearward as the seat rises or forward as the seat lowers. This would help to accomodate the longer knee-to-buttocks distance for a taller person who adjusts the seat upward, and vice-a-versa. The links 11 and 10 of FIG. 1 are replaced with links 32 and 16 respectively in FIG. 2 and the seat back support 7 is lengthened, lowering the level of flange 24. Links 32 and 16 are bent downward toward the rear of the chair. The resulting lower, more counterclockwise positioned pivots 20 and 21 relative to pivots 18 and 19 result in more rearward movement of the chair back with rise of the chair back compared to the design of FIG. 1.

Figure 3:
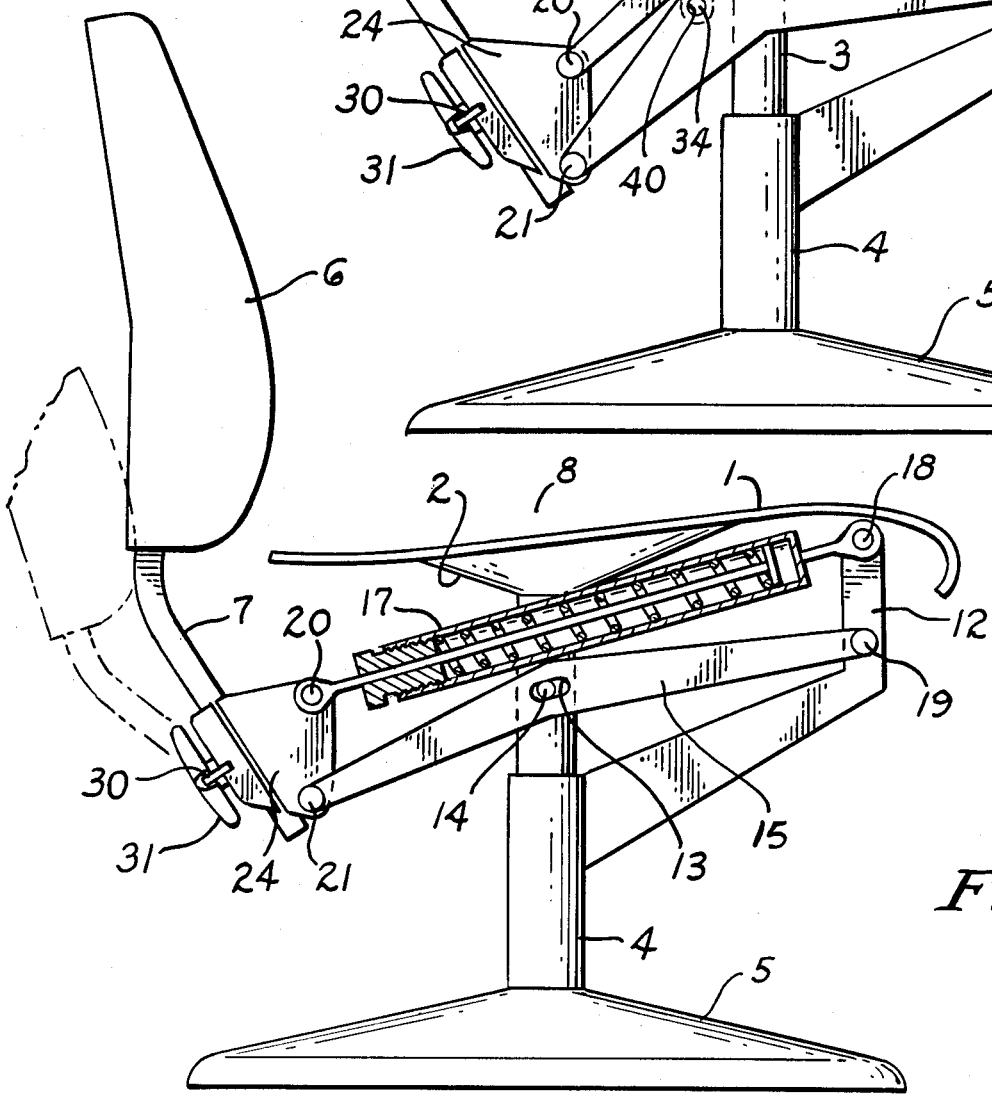
FIG. 3., also a side view, shows the incorporation of a spring effect in the upper linkage bar of the linkage. Phantom lines indicate how the chair back tilts back with the spring adjustment.

FIG. 3 shows an adaptation of FIG. 2 in which the link 32 of FIG. 2 is replaced with straight linkage 17 of variable length. This adds an additional versatility to the chair by allowing some tiltback swing to the chair back 6 under the user's pressure. Pivot pin 14, which rises and lowers with changes in the seat 1 level, activates the linkage rotation which adjusts the seat back 6 height.

Figure 5:
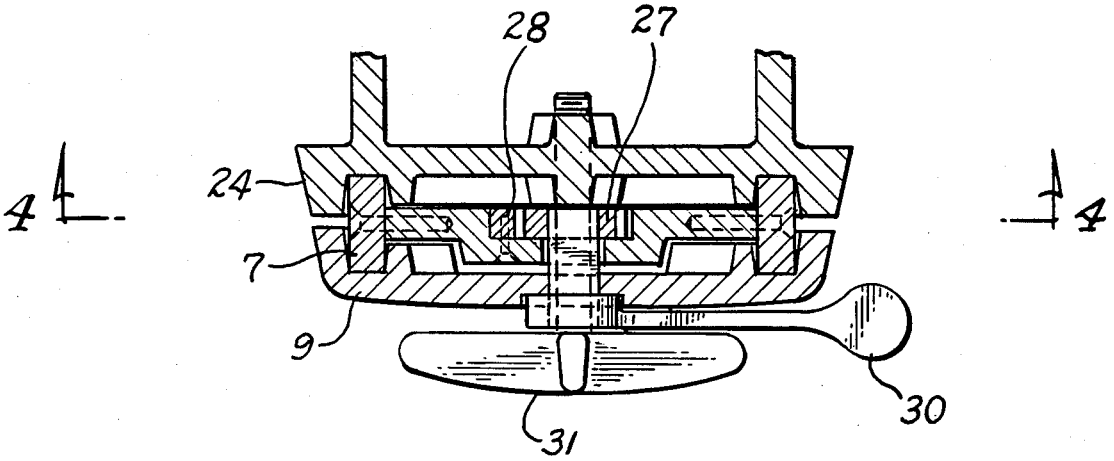
FIG. 5. is a plan view of the over-ride mechanism for back height.
Figure 4:
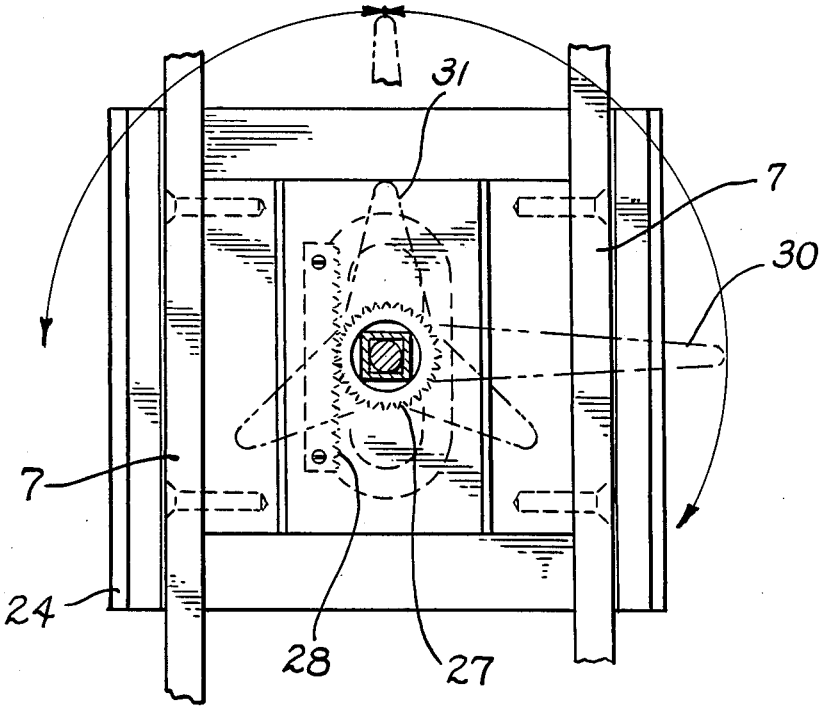
FIG. 4. is a lateral cross-section view of the over-ride adjustment mechanism for back height.

The action of the mechanism of this invention will accomodate size changes for most people, that is, the proportionate changes in the back and leg dimensional changes with changes in height. However, additional adjustment can be made using the mechanism detailed in FIGS. 4 and 5. The mechanism of FIGS. 4 and 5 overrides the adjustment created by linkage 21-14-19-18-20 or linkage 21-34-19-18-20 in FIGS. 1 and 2. It adds or subtracts distance from the height of the back rest 6 above the seat surface 1 independently of the height changes by those linkages. In FIG. 4 is shown the gear and rack override mechanism 27 and 28 with the drive gear 27 driven by the lever 30 and locked in place with the lockwheel 31. The gear rack 28 is connected with the back rest support 7, while the drive gear 27 is incorporated with the lower flange parts 9 and 24, FIG. 1. The lower sections, 9 and 24, in FIG. 1 contain the two linkage connections 21 and 20 which are part of the linkage 20-21-14-19-18 shown in FIG. 3 or linkage 20-21-34-19-18 in FIGS. 1 and 2.

I claim:

1. A chair adjustable to fit a range of people of different sizes, the chair including a base, a support column mounted in the base, a vertically extendable post within the support column, a seat, a seat support mounted on the moveable post, a moveable back rest and back rest support, a constrained linkage having stationary link pins connected with a plurality of moveable links and pins, the linkages operating to adjust the seat back support in relationship with the seat as the seat support is moved relative to the chair base, the improvement comprising:

a system of linkages located underneath the seat support, two linkage bars, an upper and a lower, the bars extending approximately in a horizontal direction, the upper and lower linkage bars extending from front to rear on the chair underneath the seat support, the linkages having two vertically spaced hinge points located to the front of the seat support, and two vertically spaced hinge points located to the rear of the seat support, the two forward linkage hinge points fixed at an elevation relative to the floor, these fixed-position linkage hinge points held by pins in a fixed member, the fixed member extending upward and outward from the support column, a post pin fixed to move vertically with the movement of the seat, the lower linkage bar having an opening formed along its length, the opening containing the post pin, the rear two linkage hinge points located in the lower portion of the moveable back rest support, the opening in the lower linkage bar positioned at a distance X from the front hinge point of that bar, the rear hinge point of the lower linkage bar located a distance Y to the rear of the opening in the lower linkage bar, the post pin restraining the lower bar and the front two linkage hinge points acting as a pivot for the total linkage system such that:

raising the moveable post causes the linkage system to rotate toward the front of the chair raising the rear linkages and raising the back rest support relative to the seat support, the degree of relative movement between the seat and the back support being a function of the ratio of the X and Y distances, this distance ratio being set to cause chages in the back height above the seat as the seat height above the floor is changed with the two changes occuring according to proportions for humans of various sizes, the result being a chair in which the back rest position rises an increased distance above the seat in accordance with the change of different persons' seat-region-to-lumbar-region distances as different persons' comfortable seat heights from the floor are different due to different persons' overall height differences.

2. A chair adjustable to fit a range of people of different sizes, the chair including a base, a support column mounted in the base, a vertically extendable post within the support column, a seat, a seat support mounted on the moveable post, a moveable back rest and back rest support, a constrained linkage having stationary link pins connected with a plurality of moveable links and pins, the linkages operating to adjust the seat back support in relationship with the seat as the seat support is moved relative to the chair base, the improvement comprising:

a system of linkages located underneath the seat support, two linkages bars, an upper and a lower, extending in approximately a horizontal direction, the upper and lower linkage bars extending from front to rear on the chair underneath the seat support, the rearward portions of the upper and lower bars being bent downward, the linkages having two vertically spaced hinged points located to the front of the seat support, and two vertically hinge points located to the rear of the seat support, the two forward linkage hinge points fixed at an elevation relative to the floor, these fixed-position linkage hinge points held by pins in a fixed member, the fixed member extending upward and outward from the support column, a post pin fixed to move vertically with the movement of the seat, the lower linkage bar having an opening formed along its length, the opening containing the post pin, the rear two linkage hinge points located in the lower portion of the moveable back rest support, the opening in the lower linkage bar positioned at a distance X from the front hinge point of that bar, the rear hinge point of the lower linkage bar located a distance Y to the rear of the opening in the lower linkage bar, the post pin restraining the lower bar and the front two linkage hinge points acting as a pivot for the total linkage system such that raising the moveable post causes the linkage system to rotate toward the front of the chair raising the rear linkages and raising the back rest support relative to the seat support, the degree of relative movement between the seat and the back support being a function of the ratio of the X and Y distances, this distance ratio being set to cause changes in the back height above the seat as the seat height above the floor is changed, with the two changes occuring according to proportions for humans of various sizes, the result being a chair in which the back rest position rises an increased distance above the seat in accordance with the change of different persons' seat-region-to-lumbar-region distances as different persons' comfortable seat heights from the floor are different due to different persons's overall height differences, and the back moves rearward relative to the seat as the seat height is increased to correspond with different persons of different heights having different length of thighs.

* * * * *